US008434457B2

(12) United States Patent
Coldren et al.

(10) Patent No.: US 8,434,457 B2
(45) Date of Patent: May 7, 2013

(54) SYSTEM AND METHOD FOR COOLING FUEL INJECTORS

(75) Inventors: Dana R. Coldren, Secor, IL (US); Eric L. Rogers, El Paso, IL (US); Fergal M. O'Shea, Washington, IL (US); Lifeng Wang, Dunlap, IL (US); Mandar A. Joshi, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 498 days.

(21) Appl. No.: 12/825,487

(22) Filed: Jun. 29, 2010

(65) Prior Publication Data

US 2011/0315118 A1 Dec. 29, 2011

(51) Int. Cl.

| | |
|---|---|
| ***F02M 61/14*** | (2006.01) |
| ***B05B 1/24*** | (2006.01) |
| ***B05B 15/00*** | (2006.01) |
| ***F01P 1/06*** | (2006.01) |

(52) U.S. Cl.

USPC ..... 123/470; 239/132; 123/41.31

(58) Field of Classification Search ..... 123/456, 123/470, 41.31; 239/132

See application file for complete search history.

(56) References Cited

U.S. PATENT DOCUMENTS

| | | | | |
|---|---|---|---|---|
| 4,168,689 | A | 9/1979 | Parr | |
| 4,267,977 | A * | 5/1981 | Stockner et al. | 239/132.3 |
| 5,143,039 | A | 9/1992 | Gmelin | |
| 5,860,394 | A | 1/1999 | Saito et al. | |
| 6,612,272 | B2 | 9/2003 | Kato et al. | |
| 6,856,222 | B1 | 2/2005 | Forck | |
| 6,880,769 | B2 | 4/2005 | Coldren et al. | |
| 6,976,474 | B1 | 12/2005 | Coldren et al. | |
| 7,021,558 | B2 * | 4/2006 | Chenanda et al. | 239/125 |
| 7,426,910 | B2 * | 9/2008 | Elwart | 123/46 E |
| 7,455,243 | B2 | 11/2008 | Coldren et al. | |
| 7,584,747 | B1 | 9/2009 | Ibrahim et al. | |
| 7,849,836 | B2 * | 12/2010 | Chang | 123/456 |
| 2004/0211394 | A1 | 10/2004 | Yager et al. | |
| 2005/0173563 | A1 | 8/2005 | Coldren et al. | |
| 2005/0224601 | A1 | 10/2005 | Baker et al. | |
| 2008/0295806 | A1 | 12/2008 | Chang et al. | |
| 2009/0241903 | A1 | 10/2009 | Ibrahim et al. | |
| 2009/0250531 | A1 | 10/2009 | Rogers et al. | |
| 2010/0077971 | A1 | 4/2010 | Venkataraghavan et al. | |
| 2010/0084489 | A1 | 4/2010 | Chang | |

FOREIGN PATENT DOCUMENTS

| | | |
|---|---|---|
| CH | 163098 | 6/1932 |
| DE | 743329 | 12/1943 |

(Continued)

*Primary Examiner* — Stephen K Cronin
*Assistant Examiner* — Pedro Gomez
(74) *Attorney, Agent, or Firm* — Miller, Matthias & Hull

(57) ABSTRACT

Various fuel injection systems and fuel injectors are disclosed that provide varying cooling rates for fuel injectors connected in series to fuel supply and drain rail. The local cooling rate for each injector is manipulated to balance the heat flux or heat transfer across the injectors disposed along the rail. The cooling rates may be manipulated by varying sizes of openings or slots in the nozzle case, by varying annular spaces disposed between the nozzle case and the portion of the injector body that houses the actuator and solenoid assembly, and by varying the size of annular spaces disposed between the nozzle case and the cylinder head. Strategic placement of slots in the nozzle case that direct more flow at the portion of the injector body that houses the actuator and solenoid assembly may also be employed. As a result, the operating temperatures of fuel injectors connected in series to a fuel rail can be manipulated and moderated so the downstream injectors are not prone to overheating.

20 Claims, 5 Drawing Sheets

FOREIGN PATENT DOCUMENTS

| | | |
|---|---|---|
| DE | 3622142 | 7/1986 |
| EP | 347914 | 6/1989 |
| GB | 827900 | 7/1957 |
| JP | 60075759 | 10/1983 |
| JP | 60101269 | 11/1983 |
| WO | 2004097205 | 11/2004 |

* cited by examiner

SYSTEM AND METHOD FOR COOLING FUEL INJECTORS

TECHNICAL FIELD

This disclosure relates generally to fuel injectors. More specifically, this disclosure relates to a system and method for cooling fuel injectors linked in series to a low pressure fuel supply and drain rail.

BACKGROUND

Some low pressure fuel supply and drain rail systems for diesel engines include fuel injectors linked in series to the low pressure fuel supply and drain rail (hereinafter, the "fuel rail"). That is, fuel is delivered by the fuel rail to the first fuel injector, which passes fuel onto the next injector and so on. The fuel injectors and fuel becomes increasingly hot as the fuel passes from the first fuel injector in communication with the fuel rail to the other fuel injectors disposed downstream because heat is added to the fuel rail at each injector for a variety of reasons. For example, hot fuel spilled from a fuel injector to the surrounding injector bore in the cylinder head can generate substantial amounts of heat that is transferred back to the fuel rail. The transferred heat accumulates as the fuel moves downstream along the fuel rail. As a result, for a six cylinder engine, the fuel injectors of the fifth and sixth cylinders experience higher operating temperatures than the fuel injectors of the first and second cylinders along the fuel rail.

Various efforts to reduce emissions of diesel engines can also contribute to high operating temperatures at the fuel injectors. For example, to reduce emissions, fuel injection pressures may be increased to provide greater atomization of the fuel when it is injected into the combustion chamber. However, any leakage of high-pressure atomized fuel tends to generate heat energy at or around the fuel injector. Further, one approach used to reduce diesel emissions is to utilize multiple injections of fuel into the combustion chamber during a single combustion event. However, to accomplish multiple injections or valve movements, additional electrical energy is required. The increase in electrical energy supplied to the actuator generates some additional heat at the fuel injector but typically less heat than spilled fuel or leaked fuel.

Therefore, the combination of efforts to reduce emissions and the use of fuel rails that link fuel injectors in series can result in high operating temperatures at the fuel injectors. Excess heat can cause dimensional instability of the injectors, which, as shown in FIG. 1, are relatively complex individual devices. In general, high operating temperatures can result in unreliable performance of electrically actuated fuel injectors. Further, excess heat or high operating temperature can adversely affect the fuel by causing varnishing or lacquering of the fuel, which also adversely affects injector performance.

Some solutions to the heat problem include indirect cooling such as passing cooling water through one or more areas of the cylinder head. However, this indirect method often may not provide sufficient cooling at the fuel injectors. Other solutions include larger fuel supply pumps, larger fuel lines and fuel cooling mechanisms. However, these solutions can significantly increase the cost of an engine.

SUMMARY OF THE DISCLOSURE

Disclosed herein is a variety of fuel injection systems with fuel injectors connected in series to a common low pressure fuel supply and drain rail with a variety of schemes for cooling the fuel injectors during operation. The term "fuel rail" will be used to refer to a fuel supply and drain rail, such as a low pressure fuel supply and drain rail. The injectors may be disposed in bores in the cylinder head that are connected in series to the fuel rail. The term "first" will be used to refer to the bore or fuel injector disposed first in the series or upstream on the fuel rail. The term "terminal" will be used to refer to the end bore or last bore and last fuel injector disposed downstream on the fuel rail. The disclosed systems can be used on engines of varying sizes with varying numbers of cylinders (e.g., 4, 6, 8, 12 or more cylinders). Hence, the number of fuel injectors can vary and the terminal injector may be the $4^{th}$, $6^{th}$, $8^{th}$, $12^{th}$, or $X^{th}$ cylinder in the series, depending on the size of the engine. For electrically activated fuel injectors connected in series to a fuel rail, without intervention, the terminal or downstream fuel injectors will operate at higher temperatures than the first or upstream fuel injectors due to heat added to the fuel rail by upstream injectors and heat absorbed from the cylinder head.

The disclosed fuel injection systems provide a greater balance in the operating temperatures of the fuel injectors by providing a lower cooling rate for fuel injectors connected first or upstream on the fuel rail and a greater cooling rate for fuel injectors connected downstream on the fuel rail. The lower cooling rate for the fuel injectors disposed upstream on the fuel rail and the higher cooling rate for the fuel injectors disposed downstream on the fuel rail may be provided by manipulating the size of the slots or opening in the nozzle cases, and/or manipulating the flow rate of fuel supplied to an injector as coolant flow between the nozzle case and solenoid assembly. In summary, the disclosed systems and techniques balance the heat transfer away from the injectors and hence, the operating temperatures of the fuel injectors by manipulating the localized heat transfer coefficient or cooling rate of each injector.

The disclosed embodiments and methods are applicable to fuel rails connected in series or in parallel to fuel injectors.

In one aspect of the disclosure, each fuel injector includes a nozzle case that includes at least one slot or opening that provides fluid communication between the fuel rail and its respective fuel injector. The at least one slot or opening of the nozzle case of the first fuel injector is smaller than the at least one slot or opening of the nozzle case of the terminal fuel injector. As a result, the internal components of the terminal fuel injector are exposed to more fuel than the internal components of the first fuel injector. Accordingly, the terminal fuel injector experiences a greater cooling rate than the first injector due to the increased exposure to fuel flowing through the fuel rail. Accordingly, in this disclosed system, the operating temperatures are balanced across the group of injectors by manipulating the size of slots or openings in the nozzle case of each fuel injector. In other words, the cooling rate experienced by each injector is manipulated.

In other aspects of the disclosure, the flow rates inside the nozzle cases are manipulated. For example, each fuel injector includes a nozzle case and an injector body with an interior annular space disposed between the nozzle case and the injector body and an exterior annular space disposed between the nozzle case and the injector bore. Each exterior annular space is in communication with the fuel rail. Each nozzle case includes at least one slot or opening that provides fluid communication between the external annular space and its respective interior annular space.

In one aspect, the external annular spaces for each injector are about the same size. The first or upstream fuel injector has a smaller interior annular space, which provides a lower flow rate through its interior annular space and a greater flow rate though its exterior annular space. Thus, the first or upstream injector experiences a lower cooling rate due to the smaller interior annular space. The terminal fuel injector, in contrast, includes a larger interior annular space. As a result, more fuel flows through the larger interior annular space of the terminal fuel injector for a greater cooling rate than experienced by the first or upstream injector.

In another aspect, the internal annular spaces for each injector are about the same size. The first or upstream fuel injector has a larger external annular space, which diverts flow from the interior annular space and provides a lower flow rate through its interior annular space. In other words, the first or upstream injector experiences a lower cooling rate due to the larger external annular space. The terminal fuel injector, in contrast, includes a smaller external annular space. As a result, more fuel is diverted to the internal annular space for a greater cooling rate than experienced by the first or upstream injector.

In another aspect, a total annular space for each injector are about the same size for each injector. The first or upstream fuel injector has a smaller interior annular space and larger external annular space, which provides a lower flow rate through its interior annular space and a greater flow rate through its exterior annular space. The terminal fuel injector, in contrast, includes a larger interior annular space and smaller external annular space. As a result, more fuel flows through the larger interior annular space of the terminal fuel injector for a greater cooling rate than experienced by the first or upstream injector.

An improved fuel injector is also disclosed which includes a nozzle case. One or more slots are strategically placed in the nozzle case in general alignment with the valve and solenoid assembly. Fuel from the fuel rail will pass through the strategically placed slots in the nozzle case and provide an increased flow or exposure to the valve and solenoid assembly for an increased cooling rate.

Any one or more of the above strategies may be combined as explained in detail below.

BRIEF DESCRIPTION OF THE DRAWINGS

FIGS. 6 and 7 are sectional/schematic illustrations of disclosed fuel injectors disposed in a bore in a cylinder head, wherein FIG. 6 shows a larger exterior annular space around the injector for lower flow through the interior annular space and lower cooling rates and FIG. 7 shows a smaller exterior annular space around the injector for higher flow through the interior annular space and higher cooling rates.

FIGS. 8 and 9 are sectional/schematic illustrations of disclosed fuel injectors disposed in a bore in a cylinder head, wherein FIG. 8 shows a larger interior annular space around the solenoid assembly for higher flows and higher cooling rates and FIG. 9 shows a smaller interior annular space around the actuator valve and solenoid assembly for lower flows and lower cooling rates.

DETAILED DESCRIPTION

In general, the heat flux Q of a static fluid/solid system can be expressed as a function of the heat transfer coefficient h, the surface area A and temperature difference between the cooling fluid and the solid surface:

$$Q \approx hA\Delta T$$

where Q is the heat flux (W); h is the heat transfer coefficient ($W/(m^2K)$); A is the heat transfer surface area ($m^2$); and $\Delta T$ is the difference in temperature between the solid surface and surrounding fluid area (K);

For dynamic systems, the equations used for calculating heat flux are complex and depend on the type of dynamic system. However, the heat flux of a dynamic system is also dependent upon the surface area utilized for heat transfer or the velocity of the cooling fluid or both. In this disclosure, one or both of these variables are manipulated for improving the temperature profile of fuel injectors connected in series along a fuel rail. In short, the flow area and fuel (coolant) flow rates are manipulated to increase the cooling rates of the downstream injectors and reduce the cooling rates of the upstream injectors, thereby balancing the operating temperatures of the fuel injectors.

Figure 1:
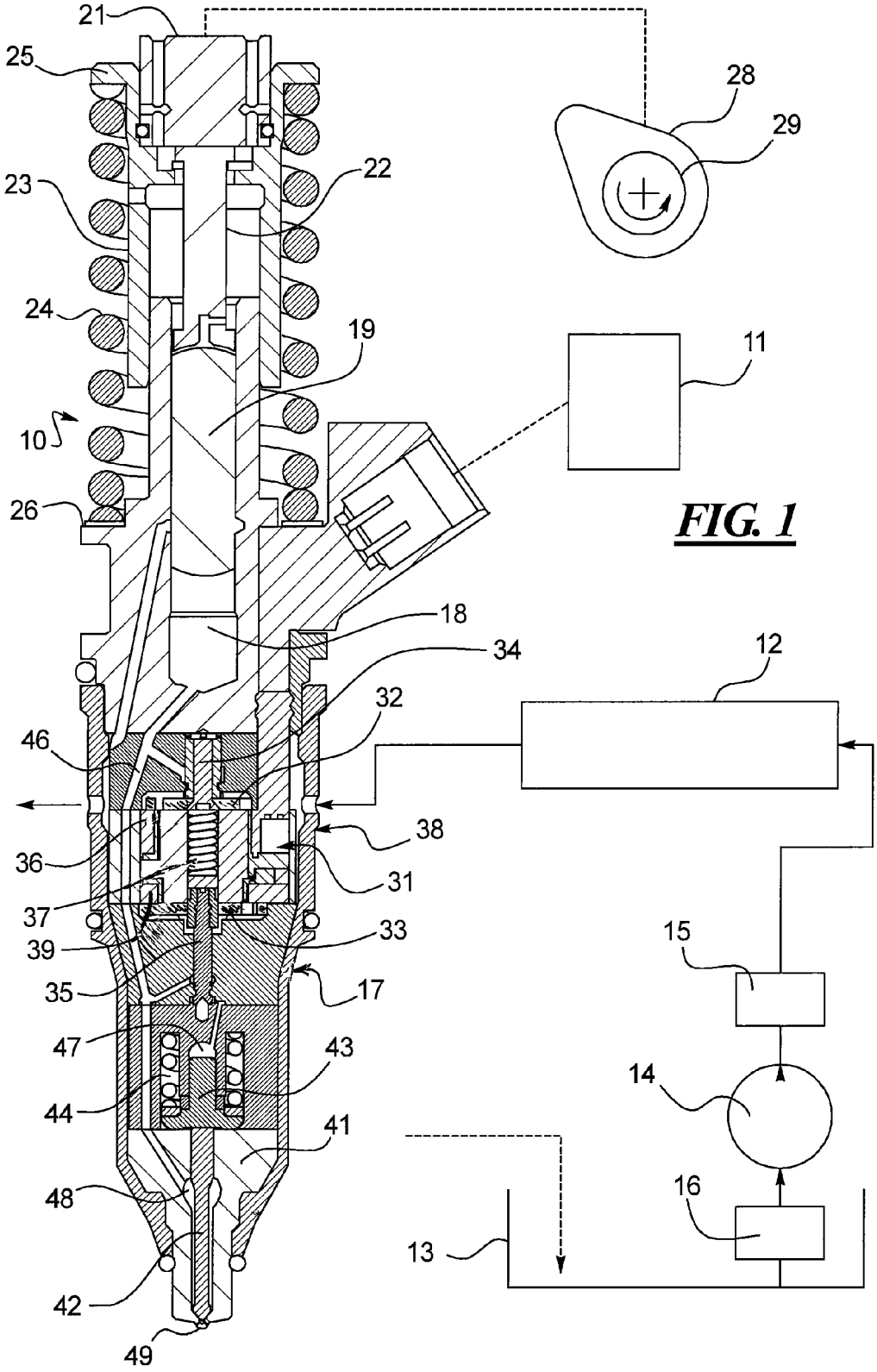
FIG. 1 is a sectional/schematic view of a disclosed mechanically actuated, electronically controlled fuel injector, linked to a cam lobe, an engine control module (ECM), and a fuel rail.
Figure 2:
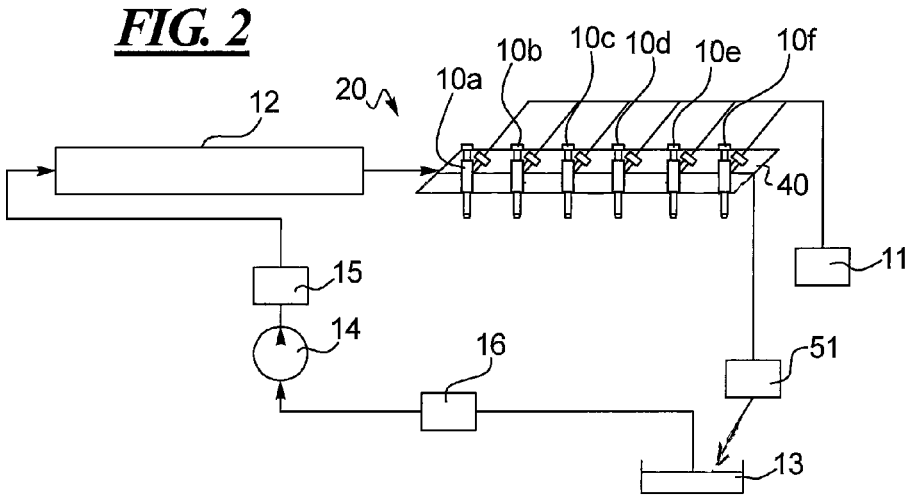
FIG. 2 is a schematic illustration of a plurality of fuel injectors as shown in FIG. 1 linked in series to a fuel rail and drain as shown in FIG. 1.

FIG. 1 illustrates a mechanically actuated and electronically controlled fuel injector 10. The fuel injector 10 is linked to an engine control module (ECM) 11 or other type of controller. The fuel injector 10 is connected to a low pressure fuel supply and drain rail, or a fuel rail 12, in series with a plurality of other injectors as illustrated in FIG. 2. As shown in FIGS. 1 and 2, the fuel rail 12 draws fuel from a tank 13 by way of a pump 14 and the fuel will typically pass through filters 15, 16 before reaching an injector 10.

The fuel injector 10 of FIG. 1 includes an injector body 17 that includes a fuel pressurization chamber 18. A plunger 19 is slideably disposed within the fuel pressurization chamber 18 and is connected to a thrust plate 21 by a shaft or link 22. The tappet 21 may be coupled to a tappet guide 23. A compression spring 24 may be trapped between a flange 25 of the tappet guide 23 and a corresponding fixed flange or shoulder 26 of the injector body 17. The tappet 21, compression spring 24 and plunger 19 move upward and downward in the orientation of FIG. 1 in response to the rotating action of the cam lobe 28 and associated camshaft 29.

The solenoid assembly 31 includes an upper armature 32 and a lower armature 33. The upper armature 32 controls the movement of the spill valve 34 and the lower armature 33 controls the movement of the control valve 35. The solenoid coils for the upper and lower armatures 32, 33 are shown at 36, 39. An armature spring 37 biases the spill valve 34 and the control valve 35 into the relaxed position or fill position shown in FIG. 1.

The fuel injector 10 also includes a nozzle 41 which accommodates a needle valve 42 which includes discharge orifices one of which can be seen at 49. A control piston 43 is biased in the downward direction by a spring 44, which biases the needle valve 42 downward into the closed position illustrated in FIG. 1. A nozzle case 38 may accommodate the nozzle 41 and the lower portion of the fuel injector body 17 including the solenoid assembly 31.

With both springs 37, 44 in a relaxed position, the fuel injector 10 may be filled with fuel from the fuel rail 12 as the thrust plate 21 moves upward. After further rotation of the cam lobe 28 causes the thrust plate 21 and plunger 19 to move downward to pressurize the fuel in the chamber 18, the ECM 11 will activate the solenoid coil 36 to draw the upper armature 32 and spill valve 34 downward against the bias of the spring 37 thereby allowing pressurized fuel to pass through the high pressure fuel passage 46 towards the needle valve 42 and lower chamber 48.

The ECM 11 will then activate the lower solenoid coil 39, raising the lower armature 33 and control valve 35 upward against the bias of the spring 37. This action releases pressure in the chamber 47 generated by activating the spill valve 34 thereby allowing the pressurized fuel in the chamber 48 to overcome the bias of the spring 44, thereby causing the needle valve 42 to move upwards and fuel to be injected through the orifice 49. When the injection is complete, the solenoid 39 deactivates the lower armature 33 followed by a deactivation or lowering of the upper armature 32 by the solenoid 36, which are controlled by the ECM 11.

Turning to FIG. 2, a fuel injection system 20 is illustrated with six fuel injectors 10*a*-10*f* are connected in series to a fuel rail 12 of a cylinder head or engine shown schematically at 40. The first injector 10*a* along the rail 12 will typically operate at a lower operating temperature than the subsequent or downstream injectors 10*b*-10*f*. The last injector in the series, or the "terminal" injector 10*f*, will typically operate at the highest temperature as heat is generated by the actuation of the injectors 10*a*-10*e* and by combustion events as fuel travels down the fuel rail 12 between the first injector 10*a* and the terminal injector 10*f*. Each injector 10*a*-10*f* may be linked to the ECM 11. The terminal injector 10*f* may be in communication with a pressure regulator 51 disposed between the terminal injector 10*f* and the fuel tank 13. Fuel used to cool the injectors 10*a*-10*f* comes from the fuel rail 12.

Figure 3:
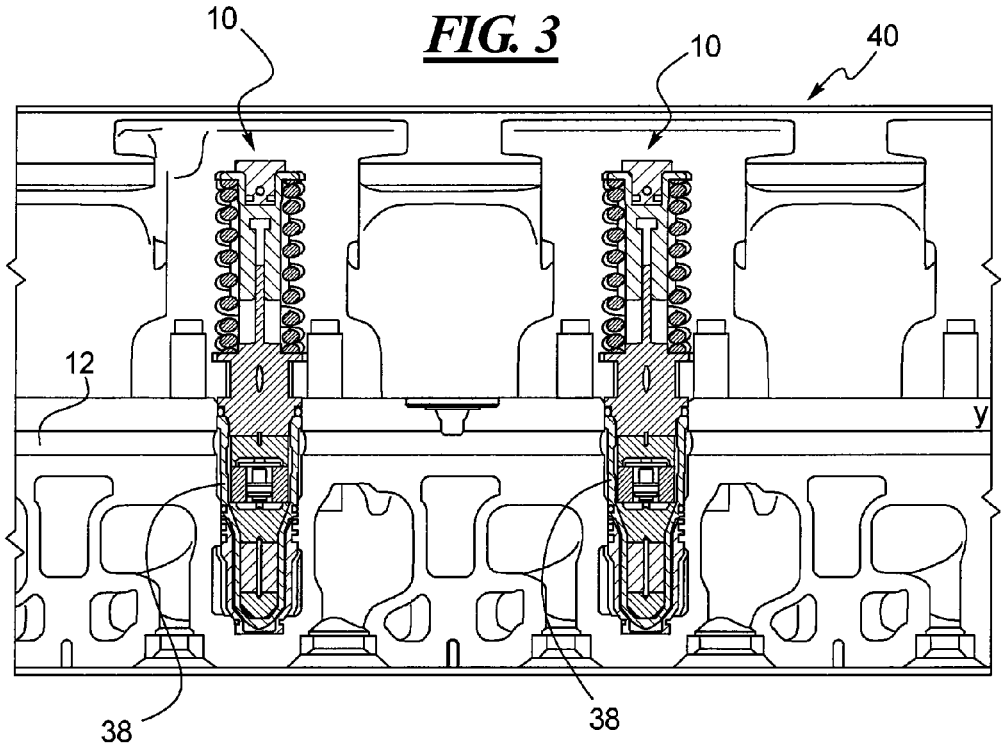
FIG. 3 is a front partial sectional/schematic view of an engine that includes two disclosed fuel injectors showing the spatial relationship between the injectors, their respective cylinder head and the fuel rail passing through the cylinder head.
Figure 4:
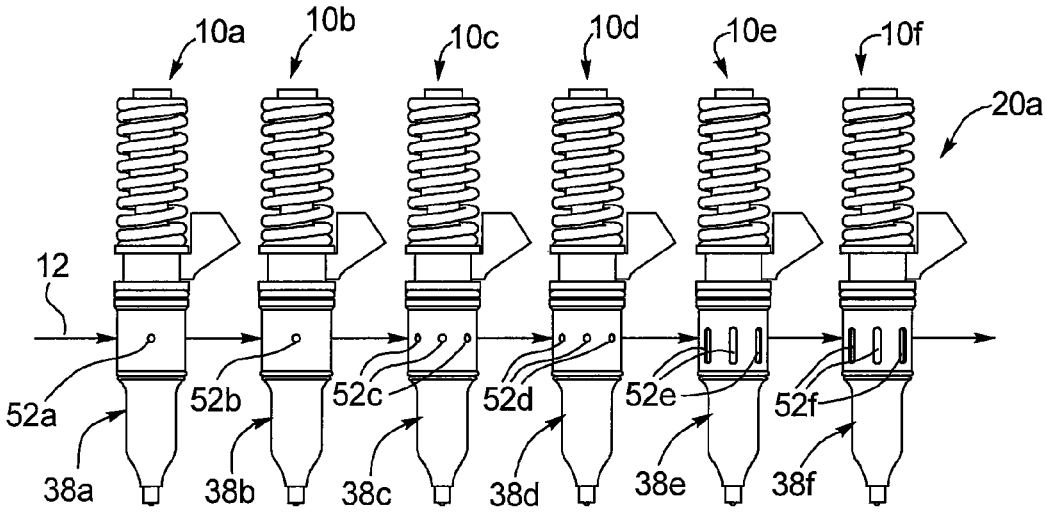
FIG. 4 is a plan/schematic view of disclosed fuel injection system with six fuel injectors linked in series to a fuel rail and illustrating different slot/hole configurations in the injector casings for providing greater cooling rates the downstream injectors shown at the right and lower cooling rates the upstream injectors shown at the left.

FIG. 3 schematically illustrates the relative positioning between the fuel rail 12 and two injectors 10 in a cylinder head 40. Fuel flowing through the rail 12 will engage the nozzle case 38 of each injector 10. FIG. 4 partially illustrates a fuel injection system 20*a* that manipulates the configurations of the nozzles cases 38*a*-38*f* of the fuel injectors 10*a*-10*f* to manipulate the localized heat transfer coefficients or, the cooling rates experienced by the injectors 10*a*-10*f*. As shown in FIG. 4, the nozzle cases 38*a*-38*f* may differ in terms of the size of the slots or openings 52*a*-52*f* in the nozzle cases 38*a*-38*f* that permit entry of fuel from the fuel rail 12 into the nozzle cases 38*a*-38*f* for purposes of cooling the injector bodies 17 and the valve and solenoid assemblies 31. FIG. 4 also teaches varying the size of the slots or openings 52*a*-52*f* for purposes of discharging heated fuel from the nozzle cases 38*a*-38*f*.

Specifically, the first or upstream injector 10*a* includes a nozzle case 38*a* with a small opening 52*a* or a plurality of small openings 52*a*. As a result, a limited amount of fuel flowing down the fuel rail 12 will enter the nozzle case 38*a* for cooling the injector 10*a* resulting in hot spilled fuel exiting the injector 10*a* through the spill valve 34 (FIG. 1) and back to the fuel rail 12. The next injector in the series, injector 10*b* may include more holes or openings 52*b* or larger openings 52*b* than the first injector 10*a*. The third injector in the series, injector 10*c*, may include more holes or openings 52*c* or larger openings 52*c* than the injectors 10*a* and 10*b*. The next injector in the series, injector 10*d* may include more holes or openings 52*d* or larger openings 52*d* than the injectors 10*a*, 10*b* and 10*c*. In addition, the last two injectors, injector 10*e* and the terminal injector 10*f* may include progressively larger holes or slots 52*e*, 52*f* respectively.

Thus, the area of the openings 52*a*-52*f* available for fuel to flow through nozzle cases 38*a*-38*f* increases progressively from the first injector 10*a* to the terminal injector 10*f*. This progressive enlargement of the openings 52*a*-52*f* available for fuel flow into and out of the nozzle cases 38*a*-38*f* provides for progressively increased cooling rates for the injectors disposed downstream along the fuel rail 12 and reduced cooling rates for the injectors disposed upstream along the fuel rail 12. As a result, the cooling rates away from the injectors 10*a*-10*f* are balanced across the array of injectors 10*a*-10*f*.

Figure 5:
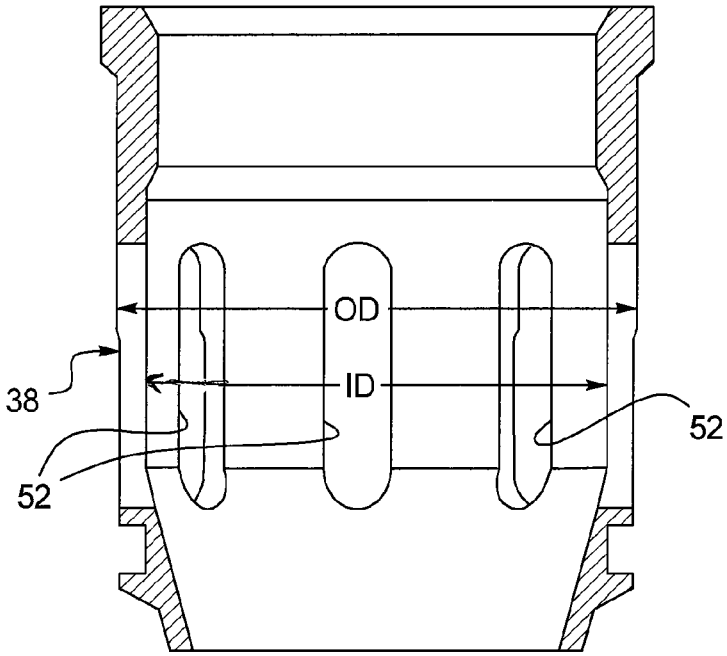
FIG. 5 illustrates a disclosed fuel injector casing with large slots for increased transfer of heat from the injector and the use of varying the outside diameter (OD) and inside diameter (ID) of the nozzle case near the solenoid assembly.

FIG. 5 illustrates a portion of a nozzle case 38 with vertically oriented slots 52 like those shown at 52*e*, 52*f* for the injectors 10*e*, 10*f* of FIG. 4. FIG. 5 also illustrates the inner and outer diameters of the nozzle case 38, which may be manipulated to increase and decrease the sizes of the interior, and exterior annular spaces 57, 58 as explained below in connection with FIGS. 6-9.

Figure 7:
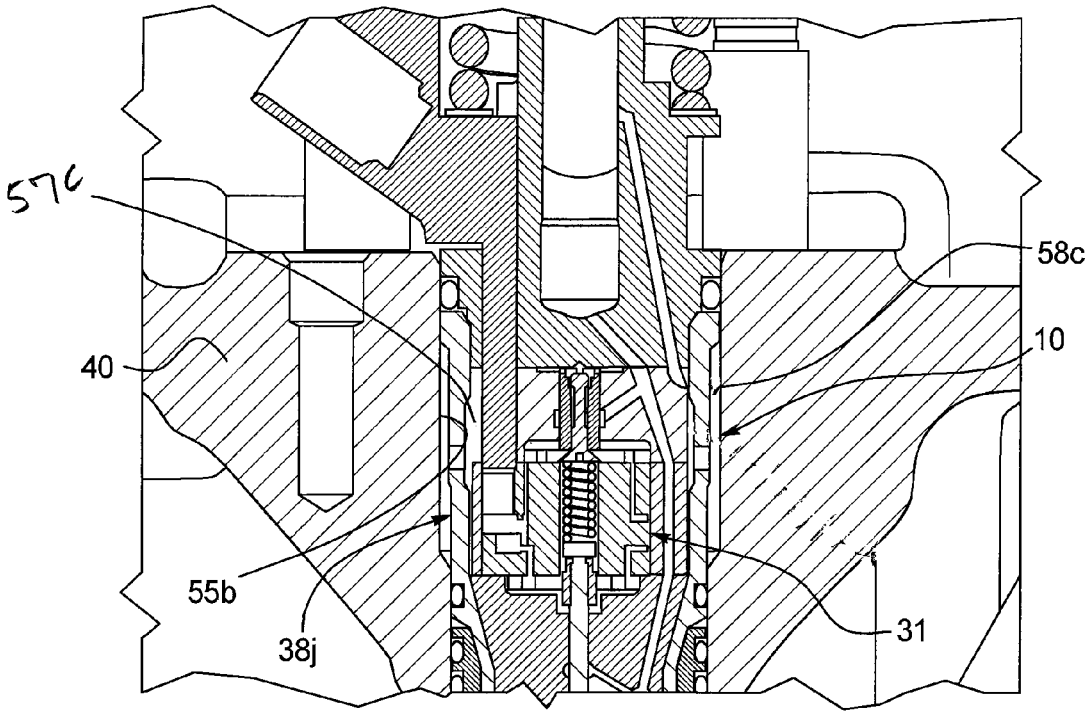
Figure 8:
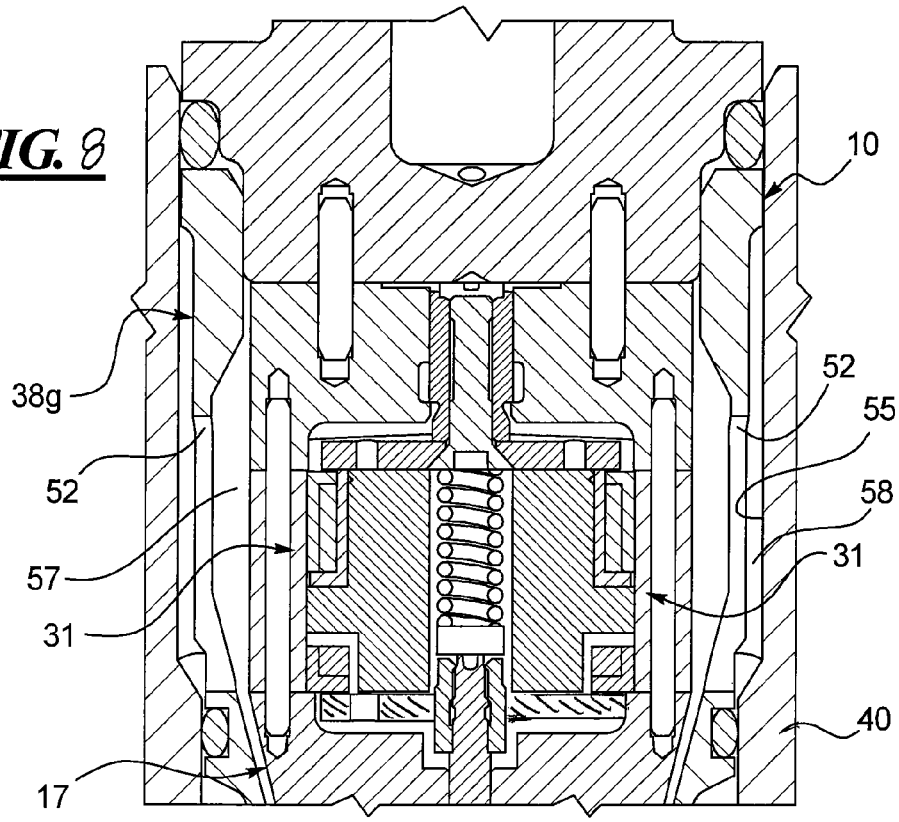

Referring briefly to FIG. 8, an injector 10 is disposed within a bore 55 drilled into a cylinder head 40. The nozzle case 38*g* is designed to provide an interior annular space 57 between the nozzle case 38*g* and the injector body 17 near the solenoid assembly 31. The nozzle case 38*g* may also be designed to provide an exterior annular space 58 between the bore 55 and the nozzle case 38*g*. Slots shown at 52 provide communication between the exterior annular space 58 and the interior annular space 57. Thus, the exterior annular space 58 and interior annular space 57 are in communication with the fuel rail 12 (not shown in FIGS. 6-9).

Figure 6:
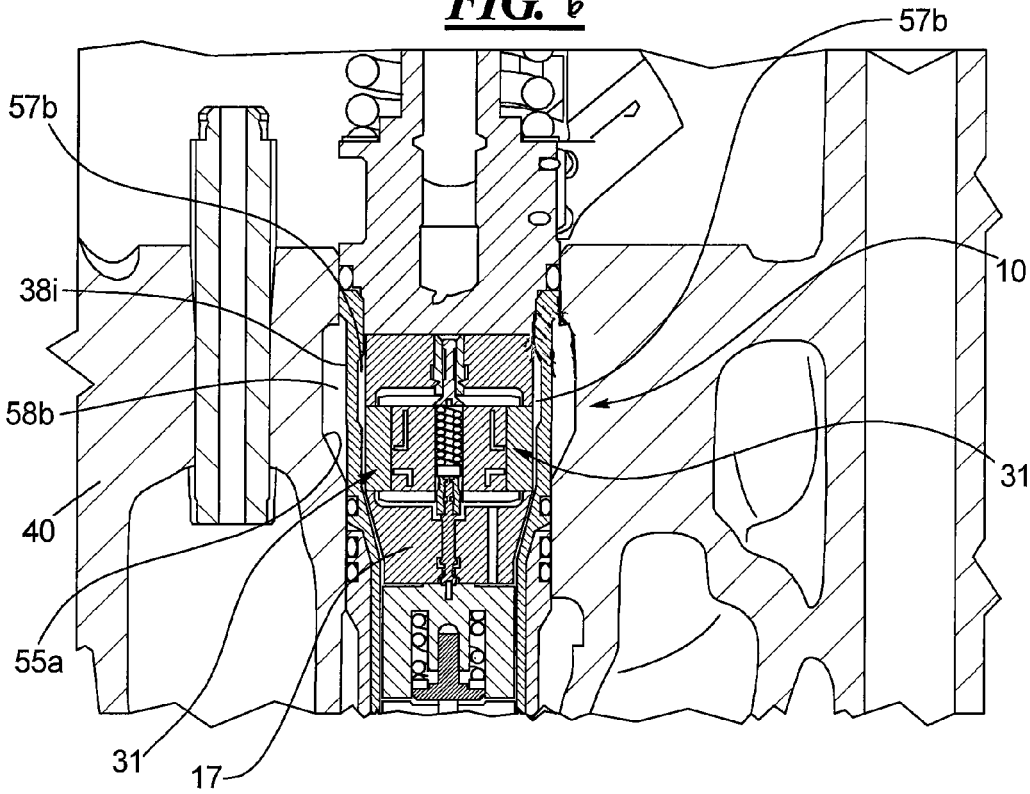

FIGS. 6 and 7 illustrate the effects of manipulating the sizes of the exterior annular spaces 58*b*, 58*c*, while maintaining the sizes of the interior annular spaces 57*b*, 57*c* about equal. As seen in FIG. 6, a substantial exterior annular space 58*b* is provided between the bore 55*a* and the nozzle case 38*i*. The larger exterior annular space 58*b* of FIG. 6 can be contrasted with the much smaller or tighter exterior annular space 58*c* disposed between the bore 55*b* and the nozzle case 38*j* as shown in FIG. 7. The tighter or smaller exterior annular space 58*c* (FIG. 7) will provide increased flow through the interior annular space 57*c* by diverting flow to the interior annular space 57*c*. In contrast, the larger exterior annular space 58*b* (FIG. 6) which will divert flow away from the interior annular space 57*b*. Accordingly, the larger exterior annular space 58*b* of FIG. 6 is appropriate for an upstream injector such as the injectors 10*a* or 10*b*, which require lower cooling rates. The tighter, or smaller exterior annular space 58*c* of FIG. 7 is appropriate for the downstream injectors 10*e* or 10*f*, which require greater cooling rates.

Therefore, when the interior annular spaces 57*b* and 57*c* are about equal in size, the flow rates thought the interior annular spaces may be manipulated by changing the sizes of the exterior annular spaces 58*b*, 58*c*. In FIG. 6, flow is diverted from the interior annular space 57*b* by the large exterior annular space 58*b* which reduces the cooling rate. In FIG. 7, flow is diverted to the interior annular space 57*c* by the small exterior annular space 58*c* which increases the cooling rate.

Figure 9:
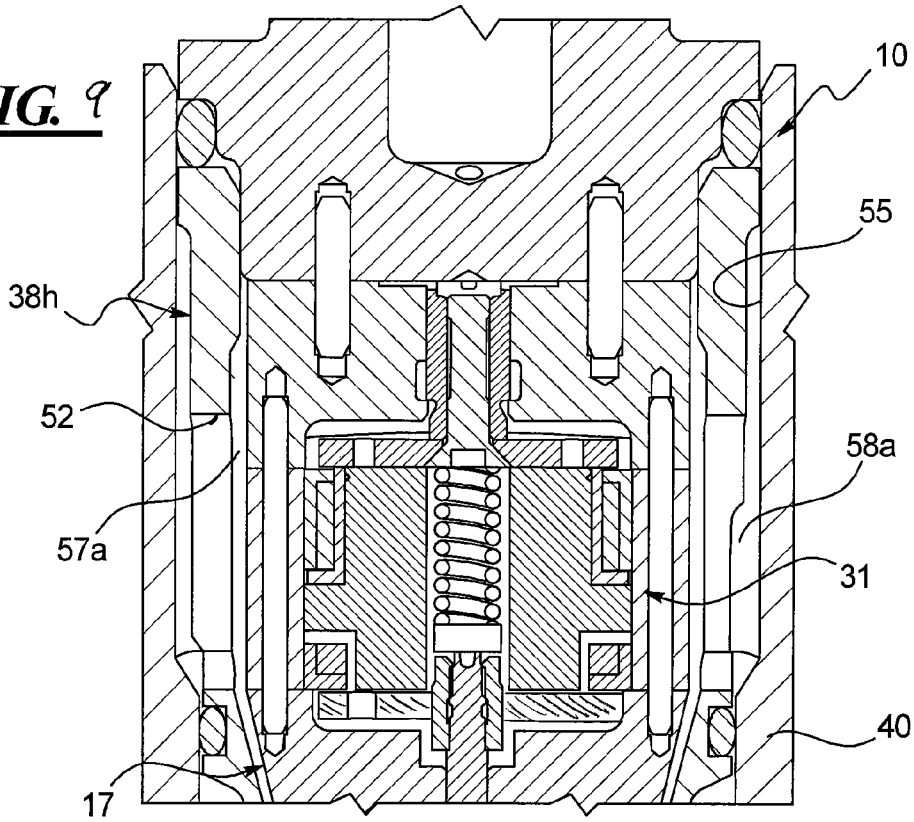

Turning to FIGS. 8-9, a cooling scheme is employed that exploits fuel flow through the interior annular spaces 57, 57*a* as a means for manipulating the localized cooling rate. The nozzle case 38*h* of FIG. 9 is designed to provide a smaller interior annular space 57*a* between the nozzle case 38*h* and the injector body 17 than of FIG. 8. The exterior annular space 58*a* of FIG. 9 is about the same size at the exterior annular space 58 shown in FIG. 8.

Comparing FIGS. 8 and 9, assuming the size of the bores 55 and the exterior annular spaces 58, 58*a* are about equal, the nozzle case 38*g* of FIG. 8 has a larger inner diameter, which provides a larger interior annular space 57 between the nozzle case 38*g* and the injector body 17. In contrast, in FIG. 9, the nozzle case 38*h* has a smaller interior diameter, which results in a smaller interior annular space 57*a*. The smaller interior annular space 57*a* of FIG. 9 generates less flow through the interior annular space 57*a* for a decreased cooling rate. In contrast, the larger interior annular space 57 of FIG. 8 creates a higher flow through the interior annular space 57 for a higher cooling rate. Accordingly, the nozzle case 38*h* (FIG. 9) is better suited for an upstream fuel injector like those shown at 10*a* or 10*b* in FIG. 2 that requires lower cooling rates. The nozzle case 38*g* (FIG. 8) is better suited for a downstream fuel injector like those shown at 10*e* or 10*f* in FIG. 2 that requires higher cooling rates.

INDUSTRIAL APPLICABILITY

Various schemes are disclosed for cooling fuel injectors connected in series to a low pressure common fuel supply and drain rail. Specifically, the sizes of the holes or openings or slots in the nozzle cases may be increased progressively with the downstream position of the injectors relative to the first or upstream injector. By manipulating the sizes of the slots or openings in the nozzle cases, reduced cooling rates may be provided to the upstream or first injector, increased cooling rates may be provided for the terminal or end injector, and progressively greater cooling rates may be provided for the middle injectors.

The size of exterior annular spaces may be manipulated while maintaining the size of interior annular spaces to divert flow from or direct flow through the interior annular spaces of the nozzle cases. In general, using a large exterior annular space and small interior annular space is suitable for the upstream injector(s) and using a smaller exterior annular space and a similar interior annular space is suitable for the downstream injector(s).

The size of the interior annular spaces may be manipulated while maintaining the size of the exterior annular spaces to increase or decrease flow through the interior of the nozzle cases and hence, the cooling rates. Larger interior annular spaces in combination with smaller exterior annular spaces are suitable for downstream injectors and smaller interior annular spaces in combination with the same or smaller exterior annular spaces are suitable for upstream injectors.

The sizes of both the interior and exterior annular spaces may also be manipulated to increase or decrease flow through the interior annular spaces for purposes of controlling the cooling rates.

Any two or more of disclosed strategies of varying the sizes of slots or openings, varying the size of the interior annular spaces and varying size the exterior annular spaces may be combined in various combinations too numerous to mention here.

By varying the design of the nozzle cases and injector bores, the heat transfer across the array of injectors can be balanced by modulating the cooling rates to compensate for hotter fuel downstream in the fuel rail.

LIST OF ELEMENTS

TITLE: System and Method for Cooling Fuel Injectors
FILE: 09-244

10 fuel injector
11 engine control module
12 fuel rail
13 fuel tank
14 pump
15 filter
16 filter
17 injector body
18 fuel pressurization chamber
19 plunger
20 fuel injection system
21 thrust plate
22 shaft
23 tappet guide
24 compression spring
25 tappet
26 shoulder
27
28 cam lobe
29 camshaft
30
31 actuator and solenoid assembly
32 upper armature
33 lower armature
34 spill valve
35 control valve
36 solenoid coil
37 armature spring
38 nozzle case
39
40 cylinder head
41 nozzle
42 needle valve
43 control piston
44 spring
45
46 high-pressure fuel passageway
47 chamber
48 chamber
49 orifices
50
51 slot
52 slot or opening
53
54
55 bore
56
57 interior annular space
58 exterior annular space

What is claimed is:

1. A fuel injection system for a cylinder head having a fuel rail and a plurality of bores for receiving fuel injectors including a first bore and a terminal bore, the bores connected in series to the rail with the first bore disposed upstream on the rail from the terminal bore, the system comprising:

a plurality of fuel injectors including a first fuel injector disposed in the first bore and a terminal fuel injector disposed in the terminal bore;

each fuel injector including a nozzle case including at least one slot providing fluid communication between the rail and its respective fuel injector;

wherein the nozzle case of the first fuel injector providing a lower cooling rate than the nozzle case of the terminal fuel injector.

2. The system of claim 1 wherein a plurality of bores are disposed between the first and terminal bores and connected in series to the fuel rail, each bore accommodating a fuel injector having a nozzle case with at least one slot for providing communication between the fuel source and its respective fuel injector, wherein the slots of the nozzle cases of the fuel injectors progressively increase in size from the first fuel injector to the terminal fuel injector so that fluid flow through the nozzle cases progressively increases from the first fuel injector to the terminal fuel injector.

3. The system of claim 1 wherein the cylinder head includes at least six bores for receiving fuel injectors including a second bore disposed downstream of the first bore, a third bore disposed downstream of the second bore, a fourth bore disposed downstream of the third bore and a fifth bore disposed downstream of the fourth bore and upstream of the terminal bore, the plurality of fuel injectors includes six fuel injectors including a second fuel injector disposed in the second bore, a third fuel injector disposed in the third bore, a fourth fuel injector disposed in the fourth bore and a fifth fuel injector disposed in the fifth bore, the second, third, fourth and fifth fuel injectors each including nozzle cases with at least one slot providing communication between the fuel source and the second, third, fourth and fifth fuel injectors respectively, the at least one slot of the nozzle case of the terminal fuel injector being larger than the slots of the nozzle cases of other fuel injectors and the at least one slot of the nozzle case of the first fuel injector being smaller than the slots of nozzle cases of the other fuel injectors.

4. The system of claim 3 wherein the slots of the nozzle cases of the fourth and fifth fuel injectors are larger than the slots of the nozzle cases of the second and third fuel injectors.

5. The system of claim 3 wherein the slots of the nozzle cases progressively increase in size from the first to the terminal fuel injectors.

6. The system of claim 1 wherein the terminal fuel injector includes an actuator and solenoid assembly, the actuator and solenoid assembly including a potted solenoid coil, and the at least one slot in the nozzle case of the terminal fuel injector includes at least one elongated slot in at least partial alignment with the actuator and solenoid coil.

7. The system of claim 1 wherein the first and terminal fuel injectors each include an injector body, the nozzle case and injector body of the first fuel injector defining a first interior annular space, the nozzle case of the first fuel injector and first bore defining a first exterior annular space, the nozzle case and injector body of the terminal fuel injector defining a terminal interior annular space, the nozzle case of the terminal fuel injector and terminal bore defining a terminal exterior annular space, the first and terminal exterior annular spaces being about equal in size, the terminal interior annular space being larger than the first interior annular space so that a flow rate through the terminal interior annular space is greater than a flow rate through the first interior annular space.

8. The system of claim 1 wherein the first and terminal fuel injectors each include an injector body, the nozzle case and injector body of the first fuel injector defining a first interior annular space, the nozzle case of the first fuel injector and first bore defining a first exterior annular space, the nozzle case and injector body of the terminal fuel injector defining a terminal interior annular space, the nozzle case of the terminal fuel injector and terminal bore defining a terminal exterior annular space, the first and terminal interior annular spaces being about equal in size, the terminal exterior annular space being smaller than the first exterior annular space thereby diverting flow to the terminal interior annular space so that a flow rate through the terminal interior annular space is greater than a flow rate through the first interior annular space.

9. The system of claim 1 wherein the first and terminal fuel injectors each include an injector body, the nozzle case and injector body of the first fuel injector defining a first interior annular space, the nozzle case of the first fuel injector and first bore defining a first exterior annular space, the nozzle case and injector body of the terminal fuel injector defining a terminal interior annular space, the nozzle case of the terminal fuel injector and terminal bore defining a terminal exterior annular space, the terminal exterior annular space being smaller than the first exterior annular space and the terminal interior annular space being larger than the first interior annular space so that a flow rate through the terminal interior annular space is greater than a flow rate through the first interior annular space.

10. A fuel injection system for a cylinder head having a fuel rail and a plurality of bores for receiving fuel injectors including a first bore and a terminal bore, the bores connected in series to the fuel rail with the first bore disposed upstream on the fuel rail from the terminal bore, the system comprising:

a plurality of fuel injectors including a first fuel injector disposed in the first bore and a terminal fuel injector disposed in the terminal bore;

each fuel injector including a nozzle case and an injector body with an interior annular space disposed therebetween, each nozzle case including at least one slot providing fluid communication between a fuel source and its respective interior annular space;

wherein the slot and interior annular space of the terminal fuel injector providing a greater cooling rate than the slot and interior annular space the first fuel injector.

11. The system of claim 10 wherein a plurality of bores are disposed between the first and terminal bores and connected in series to the fuel rail, each bore accommodating a fuel injector having a nozzle case and a fuel injector body with an interior annular space disposed therebetween, wherein the volumes of the interior annular spaces of the fuel injectors progressively increase in size from the first fuel injector to the terminal fuel injector so that flow rates through the interior annular spaces progressively increase from the first fuel injector to the terminal fuel injector.

12. The system of claim 10 wherein the cylinder head includes at least six bores for receiving fuel injectors including a second bore disposed downstream of the first bore, a third bore disposed downstream of the second bore, a fourth bore disposed downstream of the third bore and a fifth bore disposed downstream of the fourth bore and upstream of the terminal bore, the plurality of fuel injectors includes six fuel injectors including a second fuel injector disposed in the second bore, a third fuel injector disposed in the third bore, a fourth fuel injector disposed in the fourth bore and a fifth fuel injector disposed in the fifth bore, the second, third, fourth and fifth fuel injectors each including nozzle cases and fuel injector bodies with interior annular spaces disposed therebetween, the interior annular space of the terminal fuel injector is larger than the interior annular spaces of the other fuel injectors so that the flow rate through the interior annular space of the terminal fuel injector is greater than flow rates through the interior annular spaces of the other fuel injectors thereby providing the terminal fuel injector with a greater cooling rate than the other fuel injectors.

13. The system of claim 12 wherein the interior annular space of the first fuel injector is smaller than the interior annular spaces of the other fuel injectors so that the flow rate through the interior annular space of first fuel injector is less than flow rates through the interior annular spaces of the other fuel injectors thereby providing the first fuel injector with a lower cooling rate than the other fuel injectors.

14. The system of claim 10 wherein the terminal fuel injector includes an actuator and solenoid assembly, the actuator and solenoid assembly including a potted solenoid coil, and the at least one slot in the nozzle case of the terminal fuel injector includes at least one elongated slot in at least partial alignment with the actuator and solenoid coil.

15. The system of claim 10 wherein each fuel injector includes an actuator and solenoid assembly, the actuator and solenoid assembly including a potted solenoid coil, and the at least one slot in the nozzle case of each fuel injector being in at least partial alignment with the actuator and solenoid coil.

16. The system of claim 10 wherein each fuel injector includes an injector body, the first bore and the nozzle case of the first fuel injector define a first exterior annular space, the nozzle case and injector body of the first fuel injector define a first interior annular space, the terminal bore and nozzle case of the terminal fuel injector define a terminal exterior annular space, the nozzle case and injector body of the terminal fuel injector define a terminal interior annular space, the terminal exterior annular space being about equal in size to the first exterior annular space, the terminal interior annular space being larger than the first interior annular space so that a flow rate through the terminal interior annular space is greater than a flow rate through the first interior annular space.

17. The system of claim 10 wherein each fuel injector includes an injector body, the first bore and the nozzle case of the first fuel injector define a first exterior annular space, the nozzle case and injector body of the first fuel injector define a first interior annular space, the terminal bore and nozzle case of the terminal fuel injector define a terminal exterior annular space, the nozzle case and injector body of the terminal fuel injector define a terminal interior annular space, the terminal interior annular space being about equal in size to the first interior annular space, the terminal exterior annular space being smaller than the first exterior annular space so that a flow rate through the terminal interior annular space is greater than a flow rate through the first interior annular space.

18. The system of claim 10 wherein each fuel injector includes an injector body, the first bore and the nozzle case of the first fuel injector define a first exterior annular space, the nozzle case and injector body of the first fuel injector define a first interior annular space, the terminal bore and nozzle case of the terminal fuel injector define a terminal exterior annular space, the nozzle case and injector body of the terminal fuel injector define a terminal interior annular space, a combination of the terminal interior and exterior annular spaces being about equal in size to a combination of first interior and exterior annular spaces, the terminal exterior annular space being smaller than the first exterior annular space and the terminal interior annular space being larger than the first interior annular space so that a flow rate through the terminal interior annular space is greater than a flow rate through the first interior annular space.

19. An engine comprising:

a cylinder head including a fuel rail and a plurality of bores for receiving fuel injectors including a first bore and a terminal bore, the bores connected in series to the fuel rail with the first bore disposed upstream on the fuel rail from the terminal bore, a fuel injection system comprising a plurality of fuel injectors including a first fuel injector disposed in the first bore and a terminal fuel injector disposed in the terminal bore;

each fuel injector including a nozzle case with an exterior annular space disposed between the nozzle case and its respective bore for providing fuel flow from the fuel rail around its respective fuel injector;

each nozzle case including at least one slot, each fuel injector including an injector body disposed within its nozzle case that defines an interior annular space between its nozzle case and injector body that is in communication with its exterior annular space;

wherein flow rates through the exterior annular spaces progressively decrease from the first fuel injector to the terminal fuel injector and flow rates through the interior annular spaces progressively increase from the first fuel injector to the terminal fuel injector.

20. The engine of claim 19 wherein the interior annular space of the first fuel injector is smaller than the interior annular space of the terminal fuel injector so that a flow through the interior annular space of the first fuel injector is less than a flow rate through the interior annular space of the terminal fuel injector.

* * * * *